US006502705B1

(12) United States Patent
Ziegler

(10) Patent No.: US 6,502,705 B1
(45) Date of Patent: Jan. 7, 2003

(54) STORAGE RACK

(76) Inventor: Timothy A. Ziegler, 5358 Norwich Ave., Sherman Oaks, CA (US) 91411

( * ) Notice: Subject to any disclaimer, the term of this patent is extended or adjusted under 35 U.S.C. 154(b) by 0 days.

(21) Appl. No.: 09/965,728

(22) Filed: Sep. 27, 2001

(51) Int. Cl.[7] ..... A47F 5/00

(52) U.S. Cl. ..... 211/74; 211/194; 211/181.1; D7/74

(58) Field of Search ..... 211/74, 75, 181.1, 211/194, 85.31; 248/106, 107; D7/74

(56) References Cited

U.S. PATENT DOCUMENTS

D30,331 S * 3/1899 Walker ..... D7/704
1,992,411 A * 2/1935 Bruce
2,807,430 A 9/1957 Medlock
3,003,644 A * 10/1961 Hildebrand ..... 211/74
3,160,278 A * 12/1964 Varkala ..... 211/74
D222,950 S 2/1972 Majewski
3,870,155 A 3/1975 Galloway
4,700,849 A * 10/1987 Wagner ..... 211/74 X
4,787,514 A * 11/1988 Shepherd ..... 211/74 X
5,641,080 A 6/1997 Humphrey et al.
5,819,937 A * 10/1998 Walker ..... 211/74 X
5,964,343 A 10/1999 Steiner

* cited by examiner

*Primary Examiner*—Robert W. Gibson, Jr.

(57) ABSTRACT

A storage rack for storing baby bottles. The storage rack includes a frame being designed for resting on a support surface. At least one holder assembly is positioned within the frame. The holder assembly is designed for holding a baby bottle. The holder assembly is designed for facilitating storage of the baby bottle.

15 Claims, 3 Drawing Sheets

STORAGE RACK

BACKGROUND OF THE INVENTION

1. Field of the Invention

The present invention relates to bottle organizers and more particularly pertains to a new storage rack for storing baby bottles.

2. Description of the Prior Art

The use of bottle organizers is known in the prior art. More specifically, bottle organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,641,080; 5,819,937; 3,870,155; 5,964,343; 2,807,430; and U.S. Pat. No. Des. 222,950.

While these devices fulfill their respective, particular objectives and requirements, the aforementioned patents do not disclose a new storage rack. The inventive device includes a frame being designed for resting on a support surface. At least one holder assembly is positioned within the frame. The holder assembly is designed for holding a baby bottle. The holder assembly is designed for facilitating storage of the baby bottle.

In these respects, the storage rack according to the present invention substantially departs from the conventional concepts and designs of the prior art, and in so doing provides an apparatus primarily developed for the purpose of storing baby bottles.

SUMMARY OF THE INVENTION

In view of the foregoing disadvantages inherent in the known types of bottle organizers now present in the prior art, the present invention provides a new storage rack construction wherein the same can be utilized for storing baby bottles.

The general purpose of the present invention, which will be described subsequently in greater detail, is to provide a new storage rack apparatus and method which has many of the advantages of the bottle organizers mentioned heretofore and many novel features that result in a new storage rack which is not anticipated, rendered obvious, suggested, or even implied by any of the prior art bottle organizers, either alone or in any combination thereof.

To attain this, the present invention generally comprises a frame being designed for resting on a support surface. At least one holder assembly is positioned within the frame. The holder assembly is designed for holding a baby bottle. The holder assembly is designed for facilitating storage of the baby bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage rack apparatus and method which has many of the advantages of the bottle organizers mentioned heretofore and many novel features that result in a new storage rack which is not anticipated, rendered obvious, suggested, or even implied by any of the prior art bottle organizers, either alone or in any combination thereof.

It is another object of the present invention to provide a new storage rack which may be easily and efficiently manufactured and marketed.

It is a further object of the present invention to provide a new storage rack which is of a durable and reliable construction.

An even further object of the present invention is to provide a new storage rack which is susceptible of a low cost of manufacture with regard to both materials and labor, and which accordingly is then susceptible of low prices of sale to the consuming public, thereby making such storage rack economically available to the buying public.

Still yet another object of the present invention is to provide a new storage rack which provides in the apparatuses and methods of the prior art some of the advantages thereof, while simultaneously overcoming some of the disadvantages normally associated therewith.

Still another object of the present invention is to provide a new storage rack for storing baby bottles.

Yet another object of the present invention is to provide a new storage rack which includes a frame being designed for resting on a support surface. At least one holder assembly is positioned within the frame. The holder assembly is designed for holding a baby bottle. The holder assembly is designed for facilitating storage of the baby bottle.

Still yet another object of the present invention is to provide a new storage rack that facilitate organized storage of baby bottles.

Even still another object of the present invention is to provide a new storage rack that prevent baby bottles from rolling around, falling and being damaged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become, apparent when consideration is given to the following detailed description thereof. Such description makes reference to the annexed drawings wherein.

DESCRIPTION OF THE PREFERRED EMBODIMENT

Figure 1:
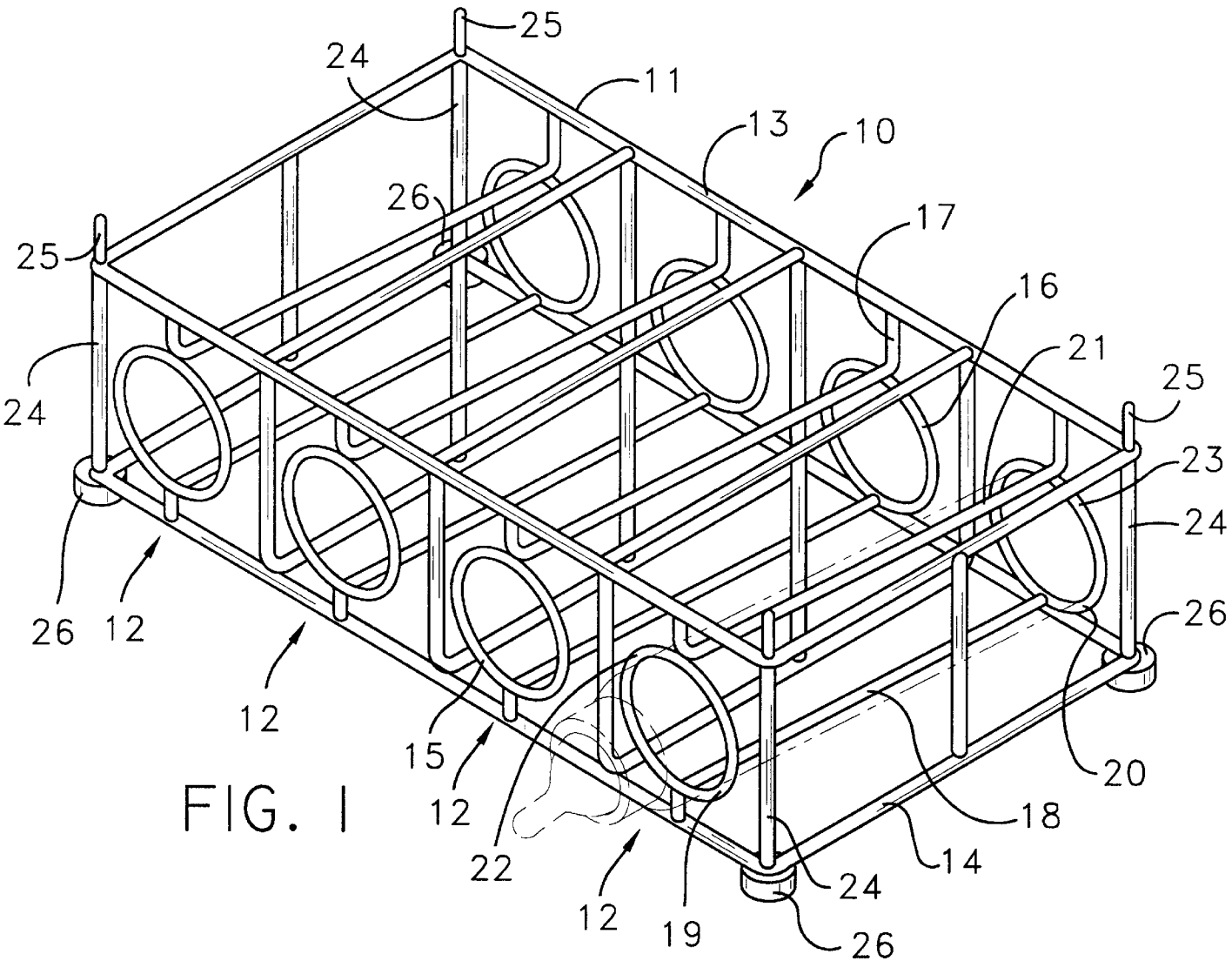
FIG. 1 is a perspective view of a new storage rack according to the present invention.
Figure 2:
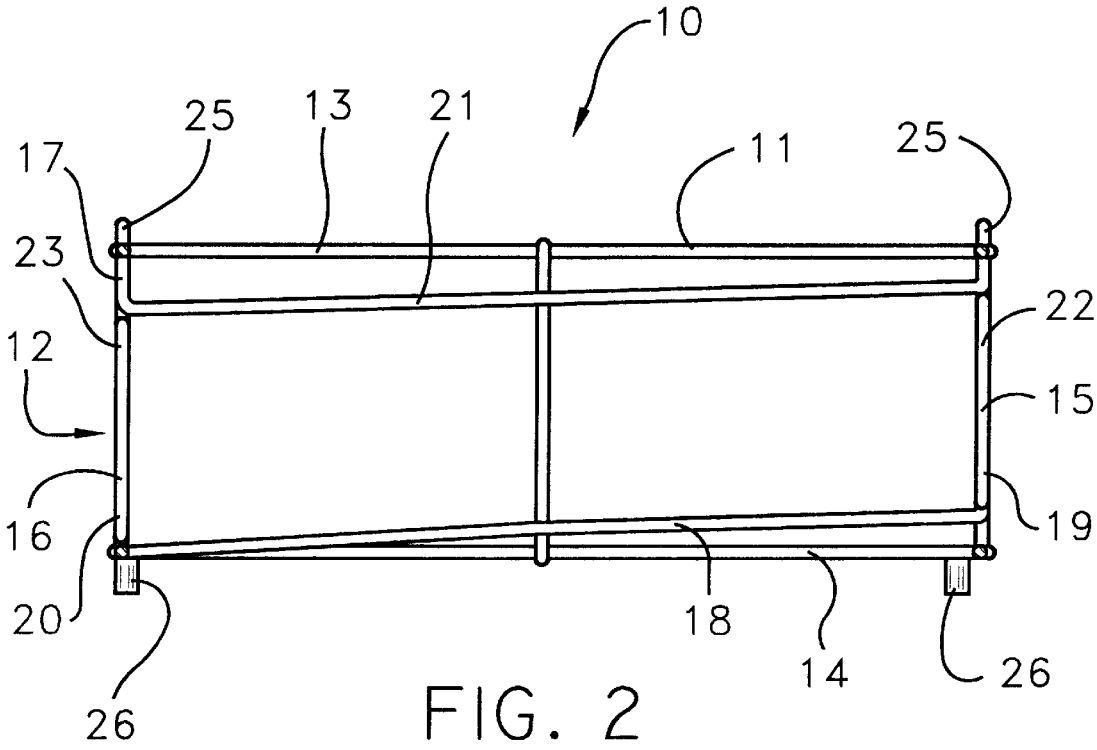
FIG. 2 is a side view of the present invention.
Figure 3:
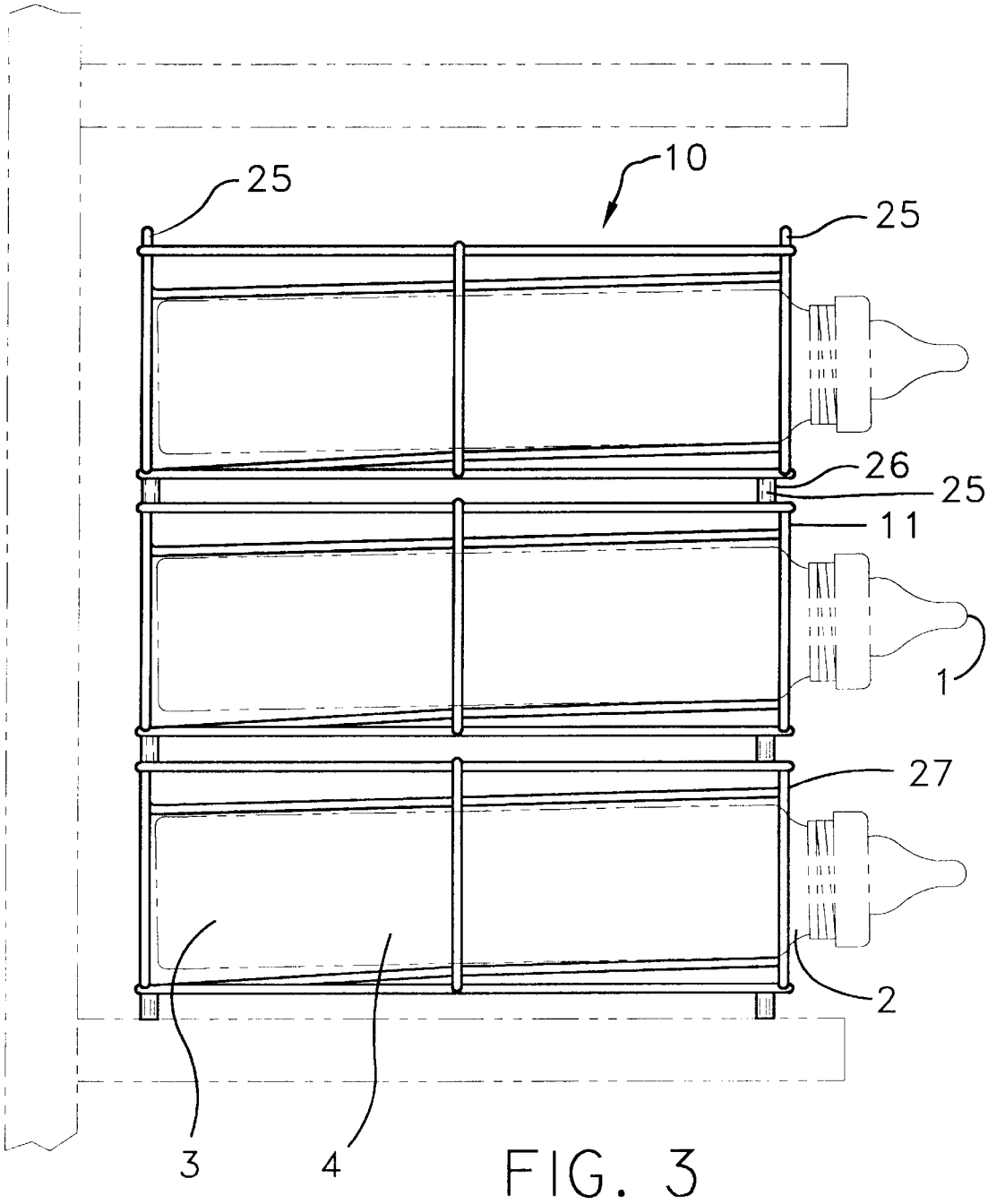
FIG. 3 is a side view of the present invention shown with multiple frames being stacked.

With reference now to the drawings, and in particular to FIGS. 1 through 3 thereof, a new storage rack embodying the principles and concepts of the present invention and generally designated by the reference numeral 10 will be described.

As best illustrated in FIGS. 1 through 3, the storage rack 10 generally comprises a frame 11 is designed for resting on a support surface. A plurality of holder assemblies 12 each being positioned within the frame 11. Each of the holder assemblies 12 is designed for holding one of the baby bottles 1 such that each of the holder assemblies 12 is designed for facilitating storage of one of the baby bottles 1.

The frame 11 has an upper perimeter member 13 and a lower perimeter member 14. The upper perimeter member 13 is coupled to the lower perimeter member 14. The lower perimeter member 14 and the upper perimeter member 13 define a storage space 14. The holder assemblies 12 are positioned within the storage space 14.

Each of the holder assemblies 12 has a front annular member 15. The front annular member 15 is coupled between the upper perimeter member 13 and the lower perimeter member 14. The front annular member 15 is designed for receiving one of the baby bottles 1 through the front annular member 15 for permitting one of the baby bottles 1 to be selectively stored in the storage space 14. The front annular member 15 is designed for supporting a front 2 end of one of the baby bottles 1 when the baby bottles 1 are positioned within the storage space 14.

Each of the holder assemblies 12 has a rear annular member 16. The rear annular member 16 is coupled between the upper perimeter member 13 and the lower perimeter member 14. The rear annular member 16 is designed for supporting a rear 3 of one of the baby bottles 1 when the baby bottles 1 are positioned within the storage space 14.

Each of the holder assemblies 12 has a rear space member 17. The rear space member 17 is positioned between the rear annular member 16 and the upper perimeter member 13 of the frame 11 such that the rear space member 17 is for positioning the rear annular member 16 lower than the front annular member 15 for storing one of the baby bottles 1 at an incline when the baby bottles 1 are positioned in the storage space 14.

Each of the holder assemblies 12 has a lower support member 18. The lower support member 18 is coupled between a lower portion 19 of the front annular member 15 of an associated one of the holder assemblies 12 and a lower portion 20 of the rear annular member 16. The lower support member 18 is designed for supporting a body 4 of one of the baby bottles 1 when the baby bottles 1 are positioned within the storage space 14.

Each of the holder assemblies 12 has an upper support member 21. The upper support member 21 is coupled between an upper portion 22 of the front annular member 15 and an upper portion 23 of the rear annular member 16 of an associated one of the holder assemblies 12. The upper support member 21 is designed for guiding the rear 3 of one of the baby bottles 1 to the rear annular member 16 when the baby bottles 1 are is positioned within the storage space 14.

The frame 11 has a plurality stanchion members 24. Each of the stanchion members 24 is positioned between the upper perimeter member 13 and the lower perimeter member 14. The stanchion members 24 are for maintaining the upper perimeter member 13 and the lower perimeter member 14 in a spaced relationship.

A plurality of alignment members 25 upwardly extend from the upper perimeter member 13. A plurality of receiving members 26 are coupled to the lower perimeter member 14. Each of the receiving members 26 is for slidably receiving one of the alignment members 25 of a second frame 27 when the frame 11 is stacked onto the second frame 27.

In use, the user places the frame into a cabinet or storage area. The user can then selectively insert baby bottles through the front annular members and allow the rear of the inserted baby bottle to rest in the rear annular member. The openness of the frame permits the user to view the baby bottles for identification. The alignment members of the frame are insertable into receiving members of a second frame for permitting the second frame to be stacked on the frame for permitting more baby bottles to be stored.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage rack for baby bottles, said storage rack comprising:

a frame being adapted for resting on a support surface;

at least one holder assembly being positioned within said frame, said holder assembly being adapted for holding a baby bottle such that said holder assembly is adapted for facilitating storage of the baby bottle;

said frame having an upper perimeter member and a lower perimeter member, said upper perimeter member being coupled to said lower perimeter member such that said lower perimeter member and said upper perimeter member define a storage space, said holder assembly being positioned within said storage space; and said holder assembly having a front annular member, said front annular member being coupled between said upper perimeter member and said lower perimeter member, said front annular member being adapted for receiving the baby bottle through said front annular member for permitting the baby bottle to be selectively stored in said storage space, said front annular member being adapted for supporting a front end of the baby bottle when the baby bottle is positioned within said storage space.

2. The storage rack as set forth in claim 1, further comprising:

said holder assembly having a rear annular member, said rear annular member being coupled between said upper perimeter member and said lower perimeter member, said rear annular member being adapted for supporting a rear of the baby bottle when the baby bottle is positioned within said storage space.

3. The storage rack as set forth in claim 2, further comprising:

said holder assembly having a rear spacing member, said rear spacing member being positioned between said rear annular member and said upper perimeter member such that said rear spacing member is for positioning said rear annular member lower than said front annular member for storing the baby bottle at an incline when the baby bottle is positioned in said storage space.

4. The storage rack as set forth in claim 2, further comprising:

said holder assembly having a lower support member, said lower support member being coupled between a lower portion of said front annular member and a lower portion of said rear annular member such that said lower support member is adapted for supporting a body of the baby bottle when the baby bottle is positioned within said storage space.

5. The storage rack as set forth in claim 2, further comprising:

said holder assembly having an upper support member, said upper support member being coupled between an upper portion of said front annular member and an upper portion of said rear annular member such that said upper support member is adapted for guiding the rear of the baby bottle to said rear annular member when the baby bottle is being positioned within said storage space.

6. The storage rack as set forth in claim 1, further comprising:

said frame having a plurality stanchion members, each of said stanchion members being positioned between said upper perimeter member and said lower perimeter member such that said stanchion members are for maintaining said upper perimeter member and said lower perimeter member in a spaced relationship.

7. The storage rack as set forth in claim 1, further comprising:

a plurality of alignment members upwardly extending from said upper perimeter member, a plurality of receiving members being coupled to said lower perimeter member, each of said receiving members being for slidably receiving one of said alignment members of a second frame when said frame is stacked onto said second frame.

8. A storage rack for baby bottles, said storage rack comprising:

a frame being adapted for resting on a support surface;

a plurality of holder assemblies each being positioned within said frame, each of said holder assemblies being adapted for holding one of the baby bottles such that each of said holder assemblies is adapted for facilitating storage of one of the baby bottles;

said frame having an upper perimeter member and a lower perimeter member, said upper perimeter member being coupled to said lower perimeter member such that said lower perimeter member and said upper perimeter member define a storage space, said holder assemblies being positioned within said storage space;

each of said holder assemblies having a front annular member, said front annular member being coupled between said upper perimeter member and said lower perimeter member, said front annular member being adapted for receiving one of the baby bottles through said front annular member for permitting one of the baby bottles to be selectively stored in said storage space, said front annular member being adapted for supporting a front end of one of the baby bottles when the baby bottles are positioned within said storage space;

each of said holder assemblies having a rear annular member, said rear annular member being coupled between said upper perimeter member and said lower perimeter member, said rear annular member being adapted for supporting a rear of one of the baby bottles when the baby bottles are positioned within said storage space;

each of said holder assemblies having a rear spacing member, said rear spacing member being positioned between said rear annular member of an associated one of said holder assemblies and said upper perimeter member such that said rear spacing member is for positioning said rear annular member lower than said front annular member for storing one of the baby bottles at an incline when the baby bottles are positioned in said storage space;

each of said holder assemblies having a lower support member, said lower support member being coupled between a lower portion of said front annular member of an associated one of said holder assemblies and a lower portion of said rear annular member such that said lower support member is adapted for supporting a body of one of the baby bottles when the baby bottles are positioned within said storage space;

each of said holder assemblies having an upper support member, said upper support member being coupled between an upper portion of said front annular member and an upper portion of said rear annular member of an associated one of said holder assemblies such that said upper support member is adapted for guiding the rear of one of the baby bottles to said rear annular member when the baby bottles are being positioned within said storage space;

said frame having a plurality stanchion members, each of said stanchion members being positioned between said upper perimeter member and said lower perimeter member such that said stanchion members are for maintaining said upper perimeter member and said lower perimeter member in a spaced relationship; and a plurality of alignment members upwardly extending from said upper perimeter member, a plurality of receiving members being coupled to said lower perimeter member, each of said receiving members being for slidably receiving one of said alignment members of a second frame when said frame is stacked onto said second frame.

9. A storage rack for baby bottles, said storage rack comprising:

a frame being adapted for resting on a support surface;

a plurality of holder assemblies each being positioned within said frame, each of said holder assemblies being adapted for holding one of the baby bottles such that each of said holder assemblies is adapted for facilitating storage of one of the baby bottles;

said frame having an upper perimeter member and a lower perimeter member, said upper perimeter member being coupled to said lower perimeter member such that said lower perimeter member and said upper perimeter member define a storage space, said holder assembly being positioned within said storage space; and each of said holder assemblies having a front annular member, said front annular member being coupled between said upper perimeter member and said lower perimeter member, said front annular member being adapted for receiving one of the baby bottles through said front annular member for permitting one of the baby bottles to be selectively stored in said storage space, said front annular member being adapted for supporting a front end of one of the baby bottles when the baby bottles are positioned within said storage space.

10. The storage rack as set forth in claim 9, further comprising:

said frame having a plurality stanchion members, each of said stanchion members being positioned between said upper perimeter member and said lower perimeter member such that said stanchion members are for maintaining said upper perimeter member and said lower perimeter member in a spaced relationship.

11. The storage rack as set forth in claim 9, further comprising:

a plurality of alignment members upwardly extending from said upper perimeter member, a plurality of receiving members being coupled to said lower perimeter member, each of said receiving members being for slidably receiving one of said alignment members of a second frame when said frame is stacked onto said second frame.

12. The storage rack as set forth in claim 9, further comprising:

each of said holder assemblies having a rear annular member, said rear annular member being coupled between said upper perimeter member and said lower perimeter member, said rear annular member being adapted for supporting a rear of one of the baby bottles when the baby bottles are positioned within said storage space.

13. The storage rack as set forth in claim 12, further comprising:

each of said holder assemblies having a rear spacing member, said rear spacing member being positioned between said rear annular member of an associated one of said holder assemblies and said upper perimeter member such that said rear spacing member is for positioning said rear annular member lower than said front annular member for storing one of the baby bottles at an incline when the baby bottles are positioned in said storage space.

14. The storage rack as set forth in claim 12, further comprising:

each of said holder assemblies having a lower support member, said lower support member being coupled between a lower portion of said front annular member of an associated one of said holder assemblies and a lower portion of said rear annular member such that said lower support member is adapted for supporting a body of one of the baby bottles when the baby bottles are positioned within said storage space.

15. The storage rack as set forth in claim 12, further comprising:

each of said holder assemblies having an upper support member, said upper support member being coupled between an upper portion of said front annular member and an upper portion of said rear annular member of an associated one of said holder assemblies such that said upper support member is adapted for guiding the rear of one of the baby bottles to said rear annular member when the baby bottles are being positioned within said storage space.

* * * * *